US007808566B2

(12) United States Patent
Honda

(10) Patent No.: US 7,808,566 B2
(45) Date of Patent: Oct. 5, 2010

(54) ACTIVE MATRIX DISPLAY DEVICE AND ELECTRONIC APPLIANCE USING THE SAME

(75) Inventor: Tatsuya Honda, Kanagawa (JP)

(73) Assignee: Semiconductor Energy Laboratory Co., Ltd., Kanagawa-Ken (JP)

( * ) Notice: Subject to any disclaimer, the term of this patent is extended or adjusted under 35 U.S.C. 154(b) by 162 days.

(21) Appl. No.: 12/168,983

(22) Filed: Jul. 8, 2008

(65) Prior Publication Data

US 2009/0073334 A1 Mar. 19, 2009

(30) Foreign Application Priority Data

Jul. 11, 2007 (JP) ..... 2007-181889

(51) Int. Cl.
*G02F 1/1343* (2006.01)

(52) U.S. Cl. ..... 349/38

(58) Field of Classification Search ..... None
See application file for complete search history.

(56) References Cited

U.S. PATENT DOCUMENTS 6,724,359 B2 * 4/2004 Yamamoto et al. ..... 345/92
6,936,845 B2 * 8/2005 Kim et al. ..... 257/59
7,518,688 B2 * 4/2009 Chen et al. ..... 349/144
2002/0084969 A1 7/2002 Ozawa

FOREIGN PATENT DOCUMENTS

| | | |
|---|---|---|
| JP | 04-145490 | 5/1992 |
| JP | 11-039855 | 2/1999 |
| JP | 11-328984 | 11/1999 |
| JP | 2002-196358 | 7/2002 |

* cited by examiner

*Primary Examiner*—Sung H Pak
(74) *Attorney, Agent, or Firm*—Nixon Peabody LLP; Jeffrey L. Costellia

(57) ABSTRACT

It is an object of the present invention to provide an active matrix display device in which reliability of transistors in a pixel can be improved by reducing a voltage applied to the transistors. The active matrix display device includes a capacitor of a pixel provided for each pixel, storage capacitors provided for each pixel, a transistor in a first group, a transistor in a second group, and a data line. When the transistor in the first group is off and the transistor in the second group is on, the storage capacitors which store charge in accordance with a potential difference of a potential of the data line and a reference potential are connected in series and a voltage obtained by raising the potential difference is applied to the capacitor of the pixel and therefore, the voltage applied to the transistors can be reduced.

23 Claims, 12 Drawing Sheets

ACTIVE MATRIX DISPLAY DEVICE AND ELECTRONIC APPLIANCE USING THE SAME

BACKGROUND OF THE INVENTION

1. Field of the Invention

The present invention relates to an active matrix display device and an electronic appliance using the active matrix display device.

2. Description of the Related Art

In recent years, as a display device such as a liquid crystal panel, an active matrix (active driving) display device in which each pixel is selectively connected to a data line (or a signal line) through a corresponding switching element so that a potential of each pixel electrode is controlled has been used in many cases. As such a switching element, a thin film transistor (TFT) has been widely used. Such an active matrix display device using a TFT has a problem in that hot carriers are generated due to a voltage applied to the TFT and thus characteristics of the TFT are degraded. When the TFT characteristics are degraded and a threshold voltage is changed, the timing of writing data to a pixel may be off or a defect in writing data may occur because the TFT is not turned on. In order to prevent such degradation of TFT characteristics, an LDD structure in which a lightly doped drain region (or an LDD region) is provided between a channel formation region and a drain region and/or a source region or a GOLD (gate overlapped drain) structure is generally adopted so that an electric field applied to a TFT is reduced. However, there is a problem that adopting these structures increases manufacturing steps or causes variation in TFT characteristics.

Patent Document 1 (Japanese Published Patent Application No. 2002-196358) discloses a liquid crystal display device in which an enough voltage to be applied to a capacitor of a liquid crystal in a pixel (that is, a capacitor formed with a pixel electrode, a counter electrode, and a liquid crystal) can be kept while a potential to be applied to a data line is suppressed to be low to reduce power consumption of the liquid crystal display device. The liquid crystal display device has an storage capacitor in addition to the capacitor of the liquid crystal in the pixel. One terminal of the storage capacitor is connected to one terminal of the capacitor of the liquid crystal in the pixel and connected to the data line through a switching element (TFT). The other terminal is connected to a capacitor line in which a potential can be varied. For example, when a switching element is turned on while an High level potential is applied to the data line, charges in accordance with the High level potential are stored in both the capacitor of the liquid crystal in the pixel and the storage capacitor. After that, the switching element is turned off and at the same time, a potential of a capacitor line connected to the other terminal of the storage capacitor is raised, so that charges in accordance with the potential difference between the raised potential and the original potential is distributed to the capacitor of the liquid crystal in the pixel. Accordingly, an effective value of a voltage to be applied to the capacitor of the liquid crystal in the pixel can be greater than that of the potential to be applied to the data line, so that a voltage high enough to drive liquid crystals (i.e., align liquid crystals) can be obtained. That is, in the liquid crystal display device disclosed in Patent Document 1, the potential to be applied to the data line can be lower than a potential for driving the liquid crystals and a voltage applied to a TFT is also low by just that much; therefore, degradation of the TFT can be prevented.

However, in the liquid crystal display device disclosed in Patent Document 1, a potential of the other terminal of the storage capacitor is required to be controlled through the capacitor line. Therefore, there has been a problem that a signal for driving the capacitor line is required to be generated separately and thus the structure becomes complicated.

SUMMARY OF THE INVENTION

An object of the present invention is to provide an active matrix display device in which a potential of a data line is reduced so that degradation of a switching transistor can be prevented and thus reliability can be improved, with a simple structure.

To achieve the above object, an active matrix display device according to the present invention is provided. The active matrix display device includes a capacitor of a pixel provided for each pixel, N (N is a positive integer which is 2 or larger) storage capacitors provided for each pixel separately from the capacitor of the pixel, a transistor in a first group, a transistor in a second group, and a data line. When the transistor in the first group is on and the transistor in the second group is off, the capacitor of the pixel and N storage capacitors are connected in parallel between the data line and a reference potential. When the transistor in the first group is off and the transistor in the second group is on, the N storage capacitors are connected in series, one terminal of the N storage capacitors which are serially connected is connected to the reference potential, and the other terminal is connected to a first terminal of the capacitor of the pixel, and a second terminal of the capacitor of the pixel is connected to the reference potential.

In such an active matrix display device of the present invention, which is described above, the transistor in the first group is turned on and the transistor in the second group is turned off first, charges in accordance with the potential difference between a potential of a data line and a reference potential are stored in the capacitor of the pixel and each of the storage capacitors (it is assumed that the reference potential is applied to one electrode of the capacitor of the pixel and one electrode of each of the storage capacitors), and then the transistor in the first group is turned off and the transistor in the second group is turned on, so that a voltage obtained by raising the potential difference between the potential of the data line and the reference potential can be applied to the capacitor of the pixel; therefore, the potential to be applied to the data line can be lower than a potential required for driving a pixel. Thus, a voltage applied to a transistor serving as a switching element in the active matrix display device can be reduced to prevent degradation of the transistor, so that reliability of the transistor can be improved.

Further, an active matrix display device according to the present invention is provided. The active matrix display device includes a capacitor of a pixel provided for each pixel; N (N is a positive integer which is 2 or larger) storage capacitors provided for each pixel, which are separated from the capacitor of the pixel; transistors in a first group, which are transistors having a first conductivity type; transistors in a second group, which are transistors having a second conductivity type opposite to the first conductivity type; a data line; and a scanning line. The transistors in the first group include a transistor connected between the data line and a first terminal of a first storage capacitor of the N storage capacitors; a transistor connected between a first terminal of an i-th ($2 \leqq i \leqq N$, i is a positive integer) of the N storage capacitors and a first terminal of a (i−1)th storage capacitor; and a transistor connected between the reference potential and a second terminal of the i-th storage capacitor. The transistors in the second group include a transistor connected between a first terminal of a j-th ($1 \leqq j \leqq (N-1)$, j is a positive integer) storage capacitor of the N storage capacitors and a second terminal of a (j+1)-th storage capacitor. A second terminal of the first storage capacitor is connected to the reference potential, a first terminal of an N-th storage capacitor is connected to the capacitor of the pixel, and a second terminal of the capacitor of the pixel is connected to the reference potential. Gate electrodes of the transistors having the first conductivity type and the transistors having the second conductivity type are connected to the scanning line in common. In one embodiment, the transistors in the first group are n-channel transistors and the transistors in the second group are p-channel transistors. Alternatively, the transistors in the first group may be p-channel transistors and the transistors in the second group may be n-channel transistors.

Thus, conductivity types of the transistors in the first group and the transistors in the second group are opposite from each other and gate electrodes of the transistors are connected to the common scanning line, so that the transistors in the first group or the transistors in the second group can be exclusively turned on or off. Therefore, a control signal for transistors in each group is not required and thus the driving structure can be prevented from being complicated.

Preferably, each capacitance of the N storage capacitors is higher than that of the capacitor of the pixel. In such a case, the rate of voltage rise is increased and the potential to be applied to the data line can be further reduced.

Further, the storage capacitors of at least two different pixels can have different capacitance. In such a case, the rate of rise of the potential difference between the potential of the data line and the reference potential can be varied for a different pixel to adjust luminance.

In one embodiment, the capacitor of the pixel is a capacitor of a liquid crystal in a pixel formed with a pixel electrode, a counter electrode, and a liquid crystal. In another embodiment, a self light-emitting material may be provided between a pixel electrode and a opposed electrode of each pixel.

In the active matrix display device according to the present invention, since a voltage obtained by raising the potential difference between a potential of a data line and a reference potential can be applied with a simple structure, the potential to be applied to the data line can be lower than that required for driving a pixel. Therefore, a voltage applied to a transistor serving as a switching element in the active matrix display device can be reduced to prevent degradation of the transistor so that reliability of the active matrix display device can be improved.

DETAILED DESCRIPTION OF THE INVENTION

Figure 1:
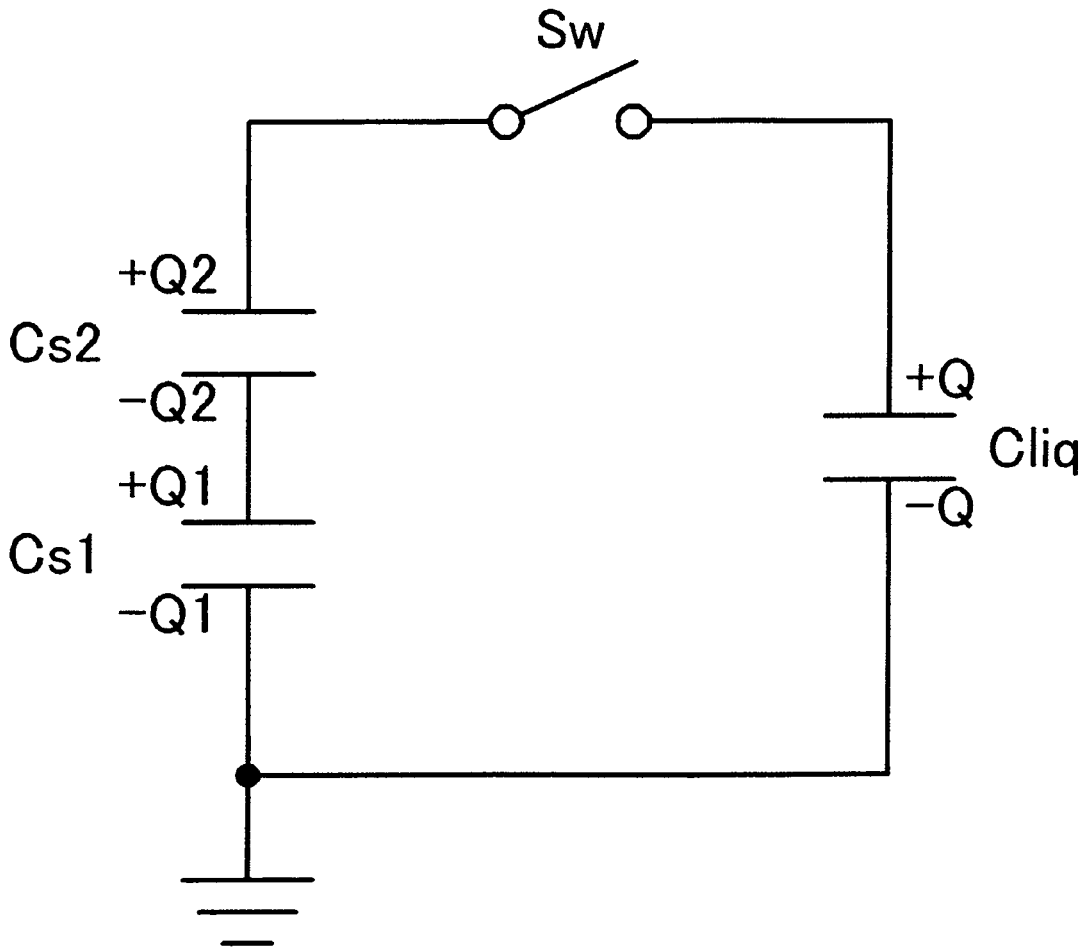
FIG. 1 is a circuit diagram illustrating a principle of the present invention.

First, a principle of the present invention is described with reference to FIG. 1. FIG. 1 illustrates a circuit including three capacitors $C_{s1}$, $C_{s2}$, and $C_{liq}$. One terminal of the capacitor $C_{s1}$ is grounded (that is, connected to the ground potential). The other terminal of the capacitor $C_{s1}$ is connected to one terminal of the capacitor $C_{s2}$. The capacitor $C_{s1}$ and the capacitor $C_{s2}$ are connected in series. A switch Sw is provided between the other terminal of the capacitor $C_{s2}$ and one terminal of the capacitor $C_{liq}$. The other terminal of the capacitor $C_{liq}$ is grounded.

When the switch Sw is open, it is assumed that charges Q1, Q2, and Q be stored in the capacitors $C_{s1}$, $C_{s2}$, and $C_{liq}$, respectively. When it is set that charges stored in the capacitors $C_{s1}$, $C_{s2}$, and $C_{liq}$ after the switch Sw is closed and enough time passes are Q1', Q2', and Q', respectively, following formulas are satisfied (in the following formulas, capacitance of each capacitor is denoted by the same reference numeral as that denotes each capacitor.

$$Q2-Q2'=Q1-Q1'=Q'-Q \quad \text{Formula 1}$$

$$(Q2'/C_{s2})+(Q1'/C_{s1})=Q'/C_{liq} \quad \text{Formula 2}$$

When Q1' and Q2' are eliminated from Formula 1 and Formula 2, following Formula 3 is obtained.

$$(-Q'+Q+Q2)/C_{s2}+(-Q'+Q+Q1)/C_{s1}=Q'/C_{liq} \quad \text{Formula 3}$$

When Formula 3 is arranged, following Formula 4 is obtained.

$$Q'/C_{liq}=[C_{s1}(Q+Q2)+C_{s2}(Q+Q1)]/[C_{s1}C_{s2}+C_{s1}C_{liq}+C_{s2}C_{liq}] \quad \text{Formula 4}$$

When the numerator and the denominator of the right-hand side in Formula 4 are divided by $C_{s1}$ $C_{s2}$, Formula 5 is obtained.

$$Q'/C_{liq}=[(Q+Q2)/C_{s2}+(Q+Q1)/C_{s1}]/[1+C_{liq}/C_{s2}+C_{liq}/C_{s1}] \quad \text{Formula 5}$$

Here, when the switch Sw is open, assuming that the voltage of each capacitor is $V_{sig}$ (that is, $Q1/C_{s1}=Q2/C_{s2}=Q/C_{liq}=V_{sig}$) and capacitance of all capacitors are equal (that is, $C_{s1}=C_{s2}=C_{liq}$), a voltage $Q'/C_{liq}$, which is applied to $C_{liq}$ after the switch is closed, is $(4/3)V_{sig}$. That is to say, the voltage applied to $C_{liq}$ is raised to 4/3 fold.

A degree of a voltage which is raised depends on the capacitance ratio of $C_{s1}$, $C_{s2}$, and $C_{liq}$. For example, when the switch Sw is open and voltages applied to the capacitors are equally $V_{sig}$, assuming that $C_{s1}=C_{s2}=2C_{liq}$ is satisfied, the voltage of $C_{liq}$ after the switch Sw is closed is $Q'/C_{liq}=(3/2)V_{sig}$, that is, raised to 1.5 fold from that before the switch Sw is closed. Further, if $C_{s1}>>C_{liq}$ and $C_{s2}>>C_{liq}$ are satisfied, $Q'/C_{liq}$ is approximately equal to $2V_{sig}$, that is, the voltage of $C_{liq}$ is raised two fold from that before the switch Sw is closed.

As is understood from the above description, if $C_{s1}$ and $C_{s2}$ in FIG. 1 are storage capacitors, $C_{liq}$ is a capacitor of a liquid crystal in a pixel, and $V_{sig}$ is a potential to be applied to a data line, even when the data line potential $V_{sig}$ is lower than a potential necessary for aligning liquid crystals, the potential difference between the potential of the data line and a reference potential is raised; therefore, a voltage which is high enough to drive the liquid crystals can be applied to $C_{liq}$. The potential $V_{sig}$, which is applied to a data line, is reduced to prevent deterioration of a switching transistor, so that reliability of the switching transistor can be improved. The principle of the present invention can be applied to not only driving a liquid crystal but driving the other materials such as self-light-emitting materials for which a higher voltage is required, for example, an inorganic EL material and an organic EL material. In the present application, a capacitor in each pixel, which can be formed of any of such materials, is called a capacitor of a pixel.

Figure 2:
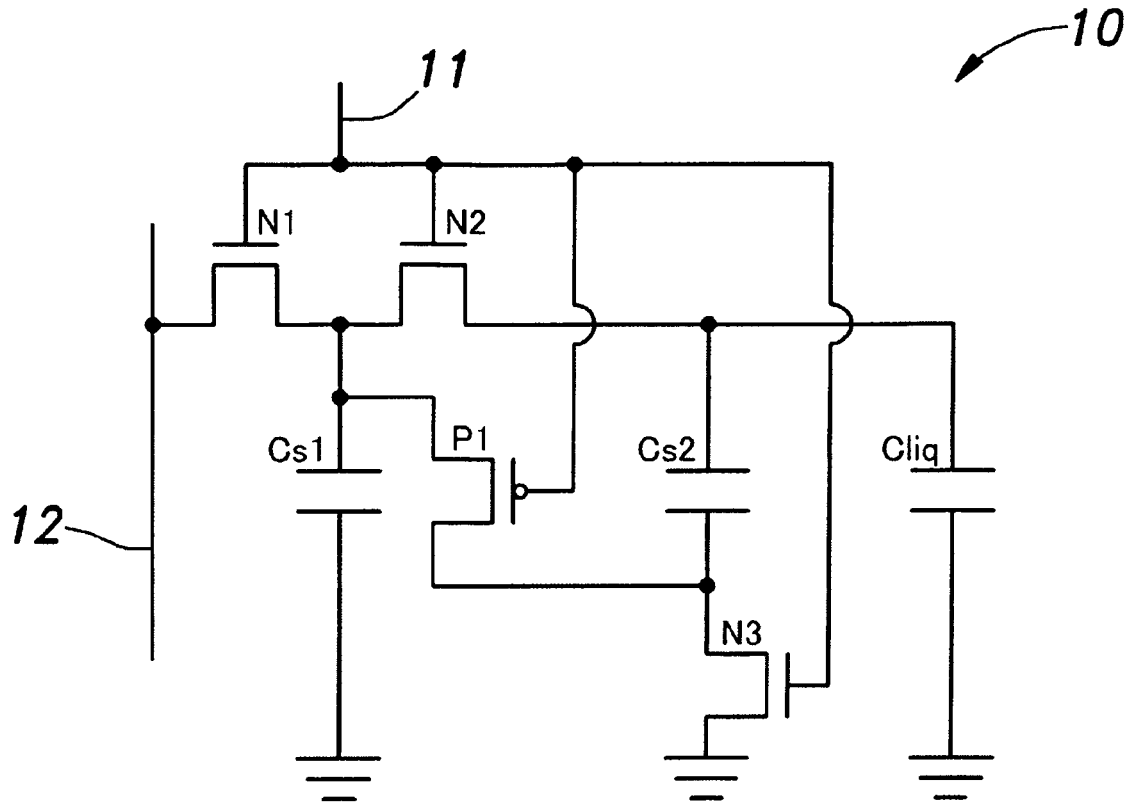
FIG. 2 is a circuit diagram illustrating an embodiment of a driver circuit of one pixel of an active matrix display device according to the present invention.

FIG. 2 is a circuit diagram illustrating a preferred embodiment of a driver circuit in one pixel of an active matrix display device using the principle of the present invention described above. This driver circuit 10 includes a capacitor $C_{liq}$ of a liquid crystal in a pixel, first and second storage capacitors $C_{s1}$ and $C_{s2}$, three n-channel transistors N1 to N3, and a p-channel transistor P1. The capacitors $C_{s1}$, $C_{s2}$, and $C_{liq}$ each have two terminals (a first terminal and a second terminal). The n-channel transistors N1 to N3 and the p-channel transistor P1 are preferably formed of TFTs and have gate electrodes connected to a scanning line 11 in common so as to be turned on or off with the same signal. A signal is supplied to the scanning line 11 so that the p-channel transistor P1 is off when the n-channel transistors N1 to N3 are on, and the p-channel transistor P1 is on when the n-channel transistors N1 to N3 are off (that is, the n-channel transistors or the p-channel transistor is exclusively turned on or off). It is to be noted that when the threshold voltage of the n-channel transistors is $V_{thn}$ and the threshold voltage of the p-channel transistor is $V_{thp}$, the threshold voltages are controlled by channel doping so that $V_{thn}>V_{thp}$ is satisfied.

The first terminal of the first storage capacitor $C_{s1}$ is connected to a data line (also called a signal line) 12 through the n-channel transistor N1, and the second terminal of the first storage capacitor $C_{s1}$ is connected to a ground potential as a reference potential. The first terminal of the second storage capacitor $C_{s2}$ is connected to the first terminal of the first storage capacitor $C_{s1}$ through the n-channel transistor N2, and the second terminal of the second storage capacitor $C_{s2}$ is connected to the ground potential through the n-channel transistor N3. The first terminal of the capacitor of the liquid crystal $C_{liq}$ is connected to the first terminal of the second storage capacitor $C_{s2}$, and the second terminal of the capacitor of the liquid crystal $C_{liq}$ is connected to the ground potential. Further, the first terminal of the first storage capacitor $C_{s1}$ is connected to the second terminal of the second capacitor $C_{s2}$ through the p-channel transistor P1.

The operation of the driver circuit 10 having such a structure will be described below. Here, a potential of the data line 12 varies between 0 to $V_{sig}$. First, the potential $V_{sig}$ is applied to the data line 12 and a potential of the scanning line 11 is set to a high potential ($V_{gH}$) such that the potential difference between the potential of the scanning line 11 and the reference potential is higher than the threshold voltage $V_{thn}$ of the n-channel transistors N1 to N3. That is, the n-channel transistors N1 to N3 are turned on and the p-channel transistor P1 is turned off. When resistance of the n-channel transistors N1 to N3 is disregarded and resistance of the p-channel transistor P1 is regarded to be infinite, the circuit in FIG. 2 is equivalent to that in FIG. 3.

Figure 3:
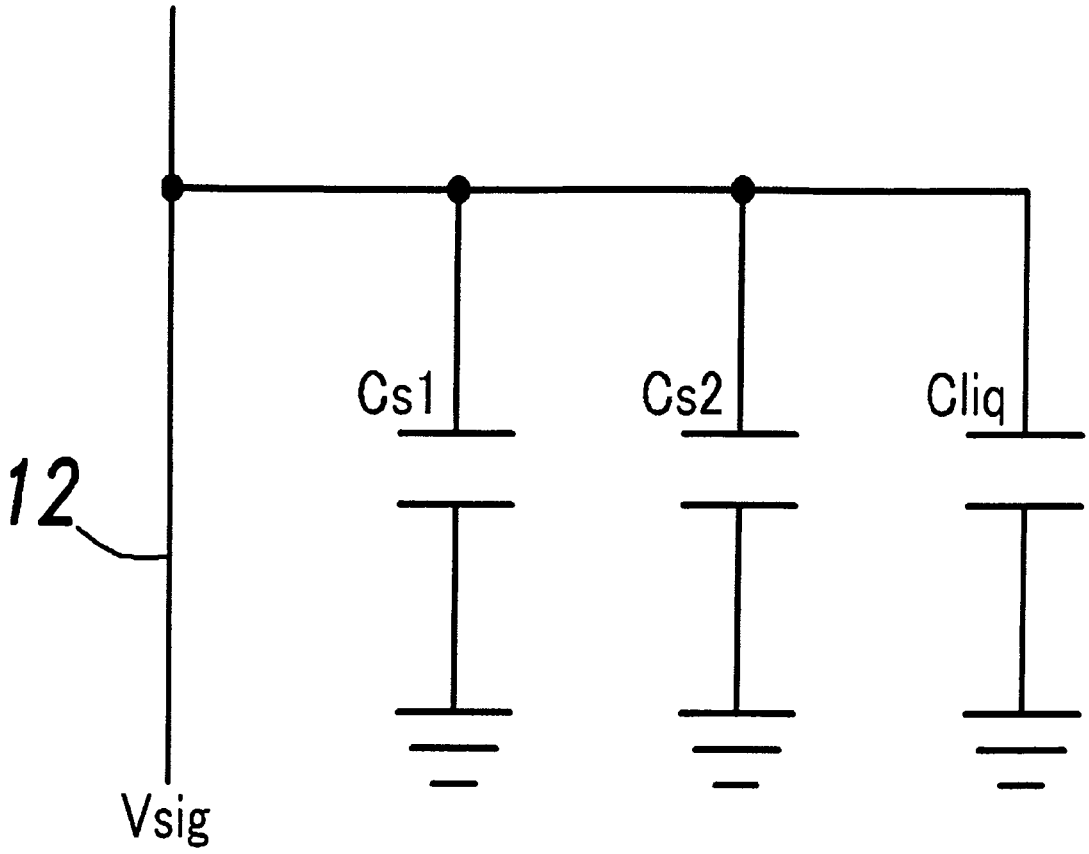
FIG. 3 is a circuit diagram illustrating an equivalent circuit in a case where transistors N1 to N3 are on and a transistor P1 is off in the driver circuit in FIG. 2.

As is inherently illustrated in FIG. 3, when the n-channel transistors N1 to N3 are on and the p-channel transistor P1 is off, the first and second storage capacitors $C_{s1}$ and $C_{s2}$ and the capacitor of the liquid crystal $C_{liq}$ are connected in parallel between the data line 12 and the ground potential. Therefore, the voltages applied to the capacitors $C_{s1}$, $C_{s2}$, and $C_{liq}$ are each equal to the voltage $V_{sig}$ of the data line 12, and a charge Q1 stored in the first storage capacitor $C_{s1}$, a charge Q2 stored in the second storage capacitor $C_{s2}$, and a charge Q stored in the capacitor of the liquid crystal $C_{liq}$ are $C_{s1}\times V_{sig}$, $C_{s2}\times V_{sig}$, and $C_{liq}\times V_{sig}$, respectively.

Figure 4:
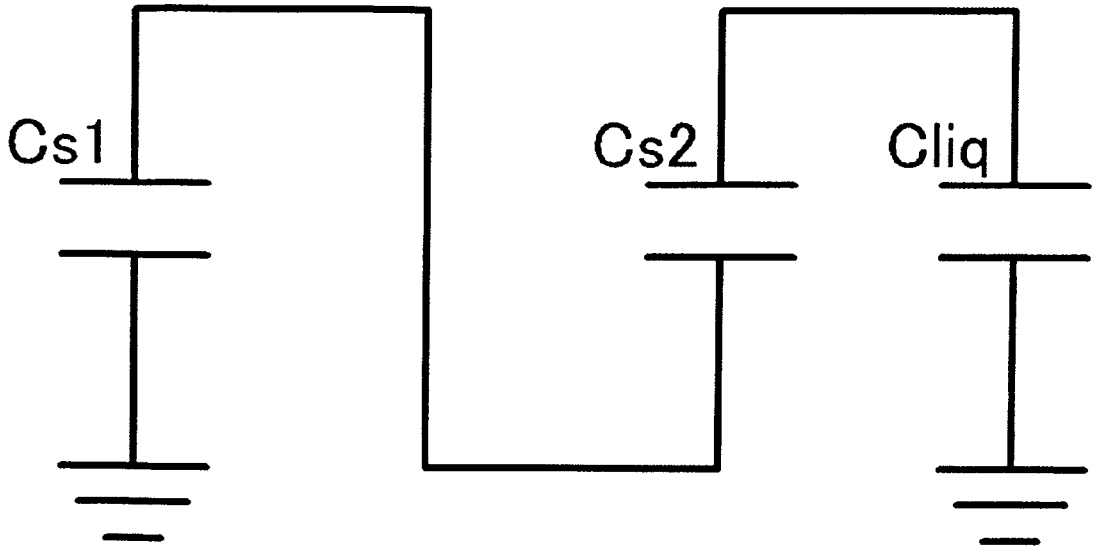
FIG. 4 is a circuit diagram illustrating an equivalent circuit in a case where transistors N1 to N3 are off and a transistor P1 is on in the driver circuit in FIG. 2.

Next, the potential of the scanning line 11 is set to a voltage ($V_{gL}$) lower than the threshold voltage $V_{thp}$ of the p-channel transistor P1 while the voltage $V_{sig}$ remains applied to the data line 12, so that the n-channel transistors N1 to N3 are off and the p-channel transistor P1 is on. In that case, if resistance of the n-channel transistors N1 to N3 are regarded to be infinite and resistance of the p-channel transistor P1 is disregarded, the circuit in FIG. 2 is equivalent to that in FIG. 4. That is, the first and second storage capacitors $C_{s1}$ and $C_{s2}$ are connected in series and one terminal of the serially connected capacitors is connected to the ground potential, the other terminal is connected to one terminal of the capacitor of the liquid crystal $C_{liq}$, and the other terminal of the capacitor of the liquid crystal $C_{liq}$ is connected to the ground potential. It is understood that the circuit in FIG. 4 is the same as the circuit in FIG. 1 in which the switch Sw is closed. Therefore, when $C_{s1}>>C_{liq}$ and $C_{s2}>>C_{liq}$ are satisfied, a potential $2V_{sig}$, which is obtained by raising the potential $V_{sig}$ of the data line 12 by two fold, is applied to the capacitor of the liquid crystal $C_{liq}$ (in the case where the reference potential is set to 0 V). That is, if a voltage necessary for aligning liquid crystals is $V_{liq}$, the potential $V_{sig}$ to be applied to the data line 12 may be half of $V_{liq}$. By thus lowering the potential to be applied to the data line 12, voltages applied to the transistors (N1 to N3 and P1) as switching elements can be reduced, so that degradation of the transistors is prevented and thus reliability of the transistors can be improved.

Note that in the circuit of FIG. 2, the conductivity types of the switching transistors may be swapped. Transistors (referred to as the transistors N1 to N3 in FIG. 2, which are transistors in a first group), which are on when the first and the second capacitors $C_{s1}$ and $C_{s2}$ and the capacitor of the liquid crystal $C_{liq}$ are connected in parallel between the data line 12 and the ground potential as in FIG. 3, and a transistor (referred to as the transistor P1 in FIG. 2, which is a transistor in a second group), which are on when the first and the second capacitors $C_{s1}$ and $C_{s2}$ and the capacitor of the liquid crystal $C_{liq}$ are connected in series as in FIG. 4, may be exclusively turned on or off.

Further, although FIG. 2, FIG. 3, and FIG. 4 each illustrate only a driver circuit of one pixel, it is needless to say that similar driver circuits can be provided for a plurality of pixels. In that case, capacitance of a storage capacitor may be varied and a voltage of a data line may be raised differently in accordance with each pixel (each sub pixel in the case where one pixel includes sub pixels for RGB). This can be achieved by, for example, varying the size of the electrode of a storage capacitor for each pixel. Accordingly, luminance can be adjusted for each pixel. For example, in the case of an inorganic EL element or the like, luminance (or emission efficiency) varies depending on a light-emitting material; therefore, luminance could vary between pixels of RGB. However, by adjusting capacitance of a storage capacitor for each pixel, luminance of RGB can be adjusted. Further, as a display device is increased in size, a difference in wiring resistance to each pixel is increased due to a difference in wiring length. Accordingly, variation is caused in a voltage applied to each pixel. As a result, for example, transmissivity of a liquid crystal may possibly vary in the case of a liquid crystal display device, and luminance of an EL element could vary in the case of a display device using the EL materials. Even in that case, by changing capacitance of a storage capacitor in accordance with wiring resistance of each pixel, a voltage to be applied to each pixel can be adjusted so that variation in liquid crystal transmsissivity or EL luminance is eliminated. Note that capacitance of a storage capacitor, which is suitable for each pixel, can be calculated in the step of designing if a wiring layout and wiring resistance per unit length are known, and the size of the electrode of each storage capacitor can be decided based on the wiring layout and the wiring resistance.

Figure 5:
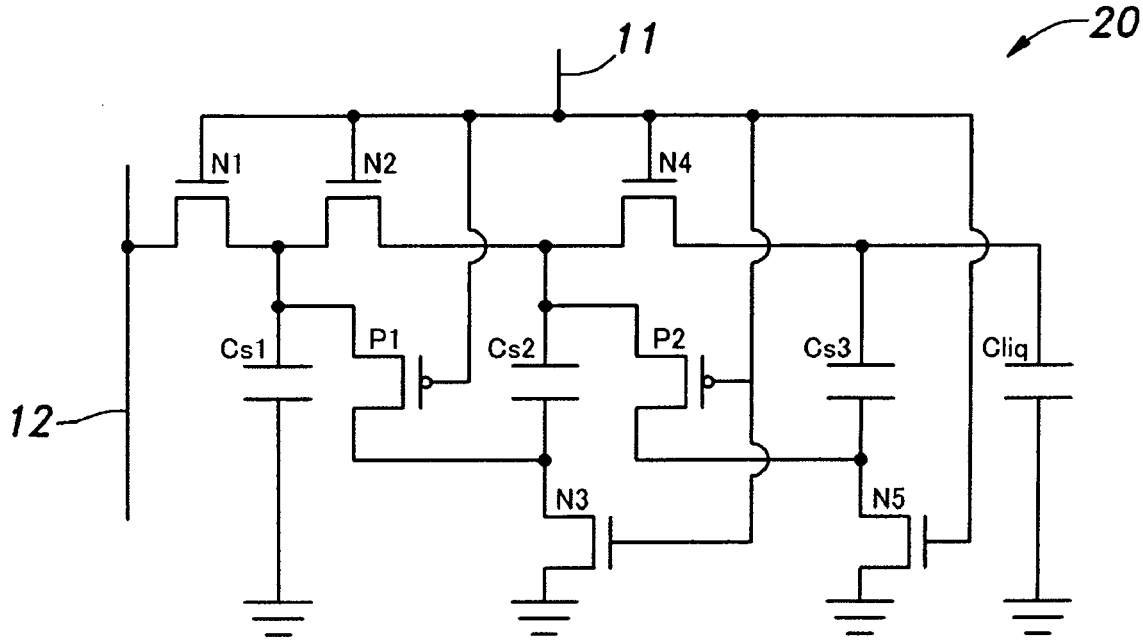
FIG. 5 is a circuit diagram illustrating another embodiment of a driver circuit of one pixel of an active matrix display device according to the present invention.

FIG. 5 is a circuit diagram illustrating another preferred embodiment of a driver circuit in one pixel of an active matrix display device according to the present invention. This driver circuit 20 is different from the driver circuit of the embodiment of FIG. 2 in that a third storage capacitor $C_{s3}$ is additionally provided and thus three storage capacitors $C_{s1}$, $C_{s2}$, and $C_{s3}$ are provided. Therefore, an n-channel transistor N4 between a first terminal of the second storage capacitor $C_{s2}$ and a first terminal of the third storage capacitor $C_{s3}$, an n-channel transistor N5 between a second terminal of the third storage capacitor $C_{s3}$ and a ground potential, and a p-channel transistor P2 between the first terminal of the second storage capacitor $C_{s2}$ and the second terminal of the third storage capacitor $C_{s3}$ are additionally provided.

The n-channel transistors N1 to N5 and the p-channel transistors P1 and P2 have gate electrodes connected to the scanning line 11 in common so as to be turned on or off with the same signal. A signal is supplied to the scanning line 11 so that the p-channel transistors P1 and P2 are off when the n-channel transistors N1 to N5 are on, or the p-channel transistors P1 and P2 are on when the n-channel transistors N1 to N5 are off (that is, the n-channel transistors or the p-channel transistors are exclusively turned on or off). It is to be noted that when the threshold voltages of the n-channel transistors and the p-channel transistors are $V_{thn}$ and $V_{thp}$, respectively, the threshold voltages are controlled by channel doping so that $V_{thn}>V_{thp}$ is satisfied.

The driver circuit 20 is operated in almost the same manner as the driver circuit 10. That is, first, the potential $V_{sig}$ is applied to the data line 12 and the potential of the scanning line 11 is set to a high potential ($V_{gH}$) such that the potential difference between the potential of the scanning line 11 and the reference potential is higher than the threshold voltage $V_{thn}$ of the n-channel transistors N1 to N5, and thereby the n-channel transistors N1 to N5 are turned on and the p-channel transistors P1 and P2 are turned off. In that case, the circuit in FIG. 5 is equivalent to that in FIG. 6.

Figure 6:
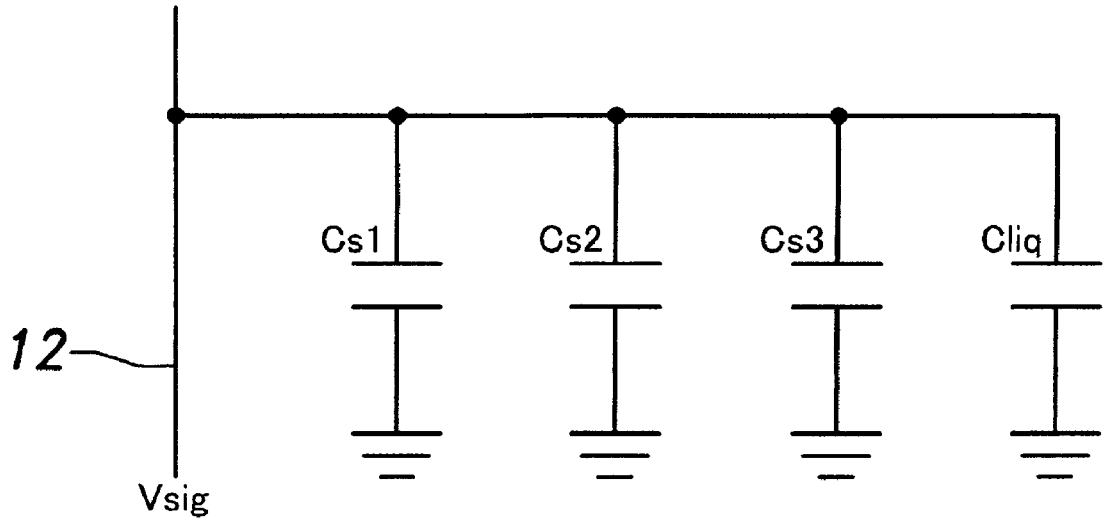
FIG. 6 is a circuit diagram illustrating an equivalent circuit in a case where transistors N1 to N5 are on and transistors P1 and P2 are off in the driver circuit in FIG. 5.

As is inherently illustrated in FIG. 6, when the n-channel transistors N1 to N5 are on and the p-channel transistors P1 and P2 are off, the first to third storage capacitors $C_{s1}$ to $C_{s3}$ and the capacitor of the liquid crystal $C_{liq}$ are connected in parallel between the data line 12 and the ground potential. Therefore, the potential difference between the potential $V_{sig}$ of the data line 11 and the reference potential is equally applied to the capacitors $C_{s1}$ to $C_{s3}$ and $C_{liq}$.

Figure 7:
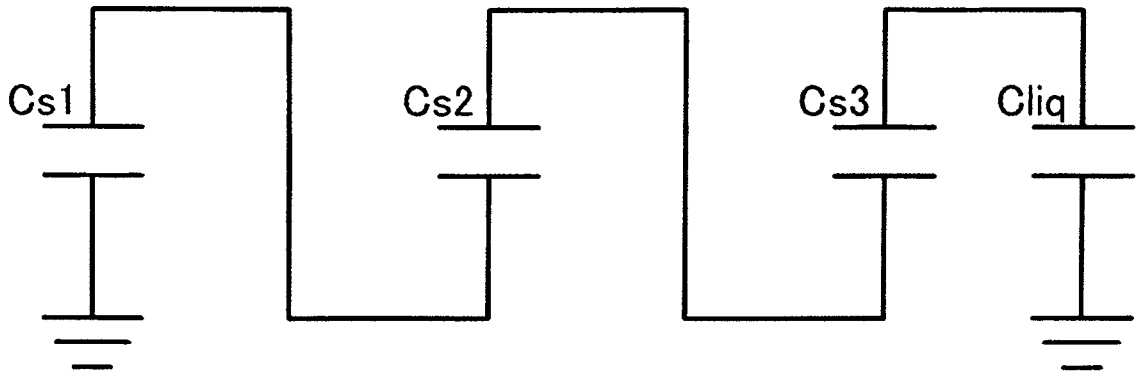
FIG. 7 is a circuit diagram illustrating an equivalent circuit in a case where transistors N1 to N5 are off and transistors P1 and P2 are on in the driver circuit in FIG. 5.

Next, the potential of the scanning line 11 is set to a low potential ($V_{gL}$) such that the potential difference between the potential $V_{sig}$ of the data line 11 and the reference potential is lower than the threshold voltage $V_{thp}$ of the p-channel transistors P1 and P2 while the potential $V_{sig}$ remains applied to the data line 12, and thereby the n-channel transistors N1 to N5 are off and the p-channel transistors P1 and P2 are on. In that case, the circuit in FIG. 5 can be equivalent to that in FIG. 7. That is, the first to third storage capacitors $C_{s1}$ to $C_{s3}$ are connected in series and one terminal of the serially connected capacitors is connected to the ground potential, the other terminal is connected to one terminal of the capacitor of the liquid crystal $C_{liq}$, and the other terminal of the capacitor of the liquid crystal $C_{liq}$ is connected to the ground potential. So, it is understood that the circuit in FIG. 7 is the same as the circuit in FIG. 1 in which the switch Sw is closed. Therefore, when $C_{s1}>>C_{liq}$, $C_{s2}>>C_{liq}$, and $C_{s3}>>C_{liq}$ are satisfied, a voltage $3V_{sig}$, which is obtained by raising the potential difference between the potential $V_{sig}$ of the data line 12 and the reference potential by three fold, is applied to the capacitor of the liquid crystal $C_{liq}$ (in the case where the reference potential is 0 V). That is, when a voltage necessary for aligning liquid crystals is $V_{liq}$, a potential to be applied to the data line 12 may be one-third of $V_{liq}$. By thus lowering the potential to be applied to the data line 12, voltages applied to the transistors (N1 to N5, P1, and P2) as switching elements can be reduced, so that degradation of the transistors can be prevented and thus reliability of the transistors can be improved.

Note that although the embodiment of FIG. 2 includes the two storage capacitors $C_{s1}$ and $C_{s2}$ and the embodiment of FIG. 5 includes the three storage capacitors $C_{s1}$, $C_{s2}$, and $C_{s3}$, the present invention is not limited thereto. In general, N (N is a positive integer which is 2 or larger) storage capacitors can be used (that is, N=2 in the embodiment of FIG. 2, and N=3 in the embodiment of FIG. 5). Further, the present invention can also be applied to driving of a display device using any of the other materials such as self-light-emitting materials, for example, an inorganic EL material and an organic EL material, instead of a liquid crystal. By lowering a potential to be applied to a data line, degradation of switching transistors used in a driver circuit can be prevented and thus reliability of the switching transistors can be improved.

Next, a preferred structure and manufacturing method of a transistor, which can be used for such a display device of the present invention, which is described above, will be described.

Figure 8A:
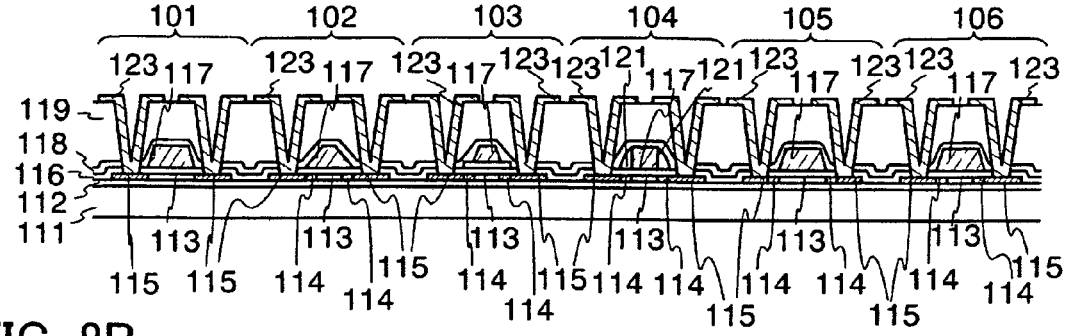
FIG. 8A is a view illustrating an example of a structure of a transistor capable of being used in the present invention.
Figure 8B:
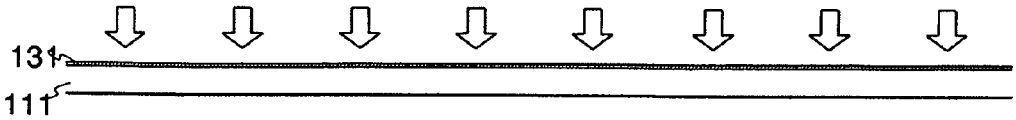
FIGS. 8B to 8G are views illustrating an example of a method for manufacturing the transistor.
Figure 8C:
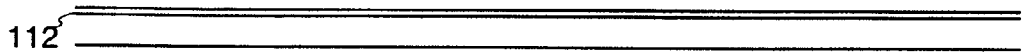
Figure 8D:
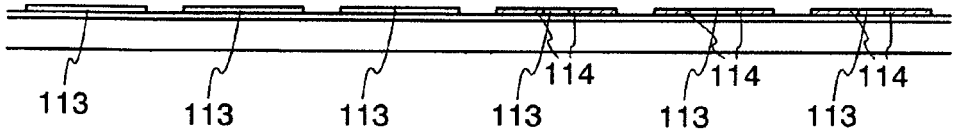
Figure 8E:
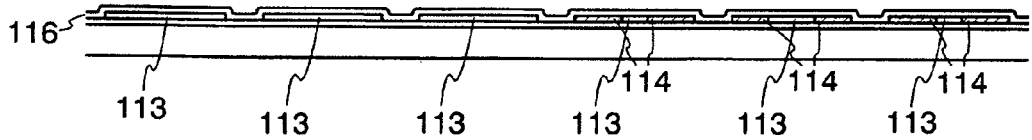
Figure 8F:
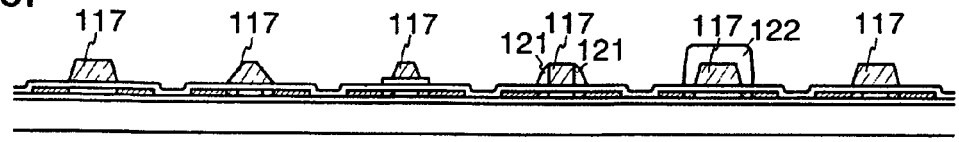
Figure 8G:
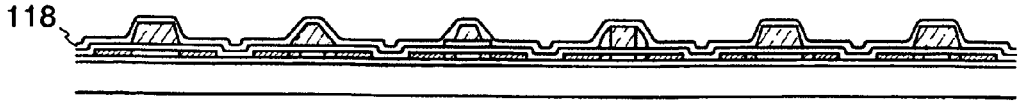
Figure 9A:
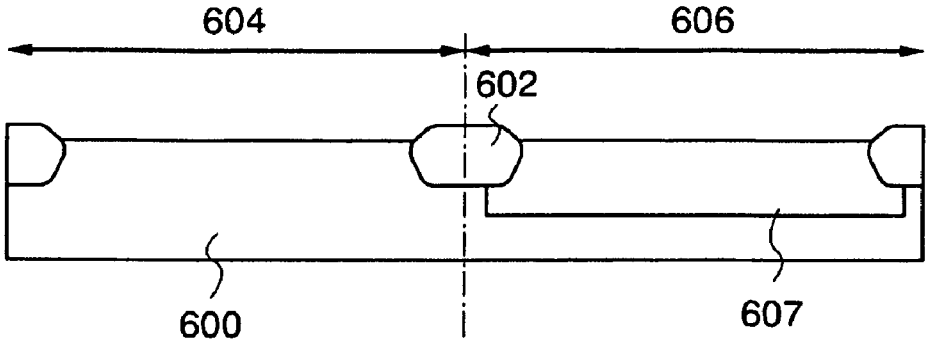
FIGS. 9A to 9C are views illustrating an example of a method for manufacturing a transistor with the use of a semiconductor substrate.
Figure 9B:
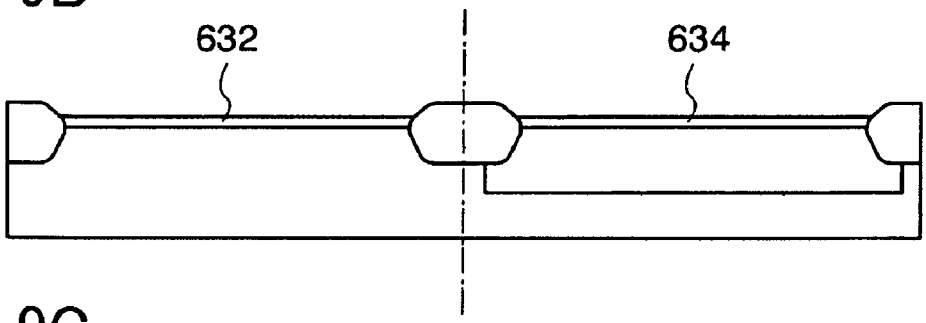
Figure 9C:
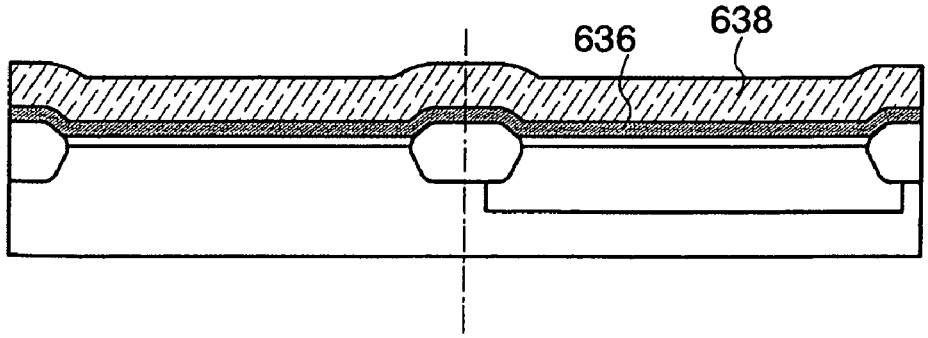
Figure 10A:
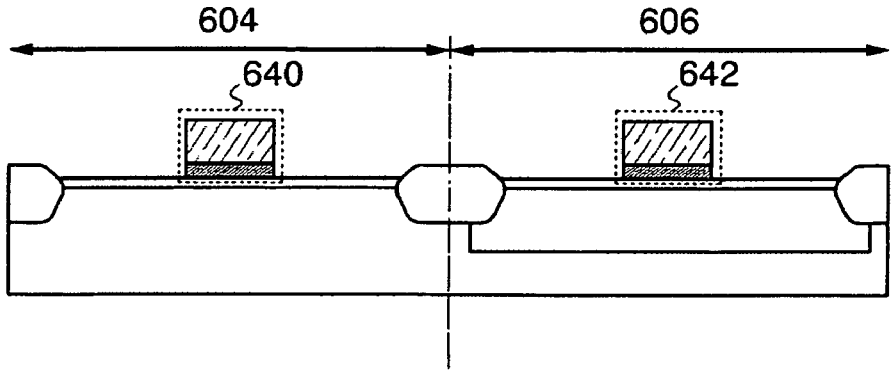
FIGS. 10A to 10D are views illustrating an example of a method for manufacturing a transistor with the use of a semiconductor substrate.
Figure 10B:
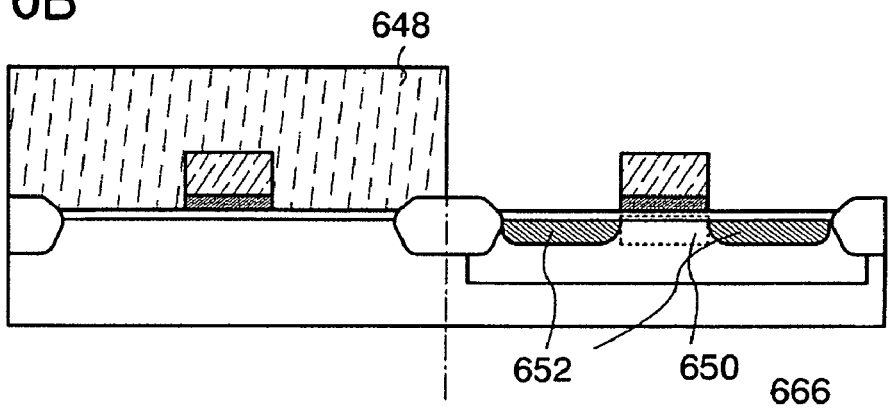
Figure 10C:
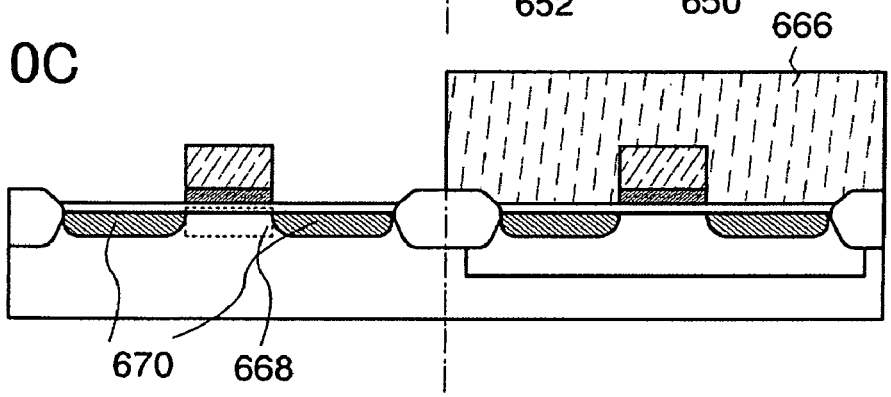
Figure 10D:
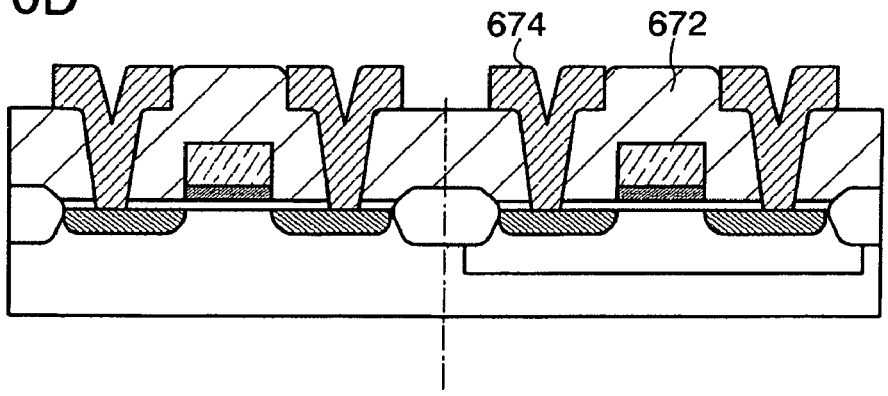

FIGS. 8A to 8G are views illustrating an example of the structure and manufacturing method of a transistor. FIG. 8A is a view illustrating the example of the structure of a transistor. FIGS. 8B to 8G are views illustrating the example of the manufacturing method of a transistor.

Note that the structure and manufacturing method of a transistor are not limited to those illustrated in FIGS. 8A to 8G, and various structures and manufacturing methods can be used.

First, the example of the structure of a transistor is described with reference to FIG. 8A. FIG. 8A is a cross-sectional view of a plurality of transistors having different structures. Here, FIG. 8A shows that the plurality of transistors having different structures is apposed for describing the structures of the transistors. However, the transistors are not required to be actually apposed as shown in FIG. 8A and can be formed depending on each case.

Next, the characteristics of each layer included in the transistor are described.

As the substrate 111, a glass substrate such as a barium borosilicate glass substrate or an aluminoborosilicate glass substrate, a quartz substrate, a ceramic substrate, a metal substrate containing stainless steel, or the like can be used. Alternatively, a substrate formed of plastics typified by polyethylene terephthalate (PET), polyethylene naphthalate (PEN), or polyethersulfone (PES), or a substrate formed of a flexible synthetic resin such as acrylic may be used. By using a flexible substrate, a bendable semiconductor device can be manufactured. A substrate to be used as the substrate 111 has no significant restrictions on the area and shape thereof as long as it is flexible, and thus, by using a rectangular substrate with a side of one meter or longer for example, the productivity can be significantly improved. Such a merit is highly advantageous as compared with a case of using a circular silicon substrate.

An insulating film 112 serves as a base film. The insulating 112 is provided to prevent alkali metal such as Na or alkaline earth metal from the substrate 111 from adversely affecting characteristics of a semiconductor element. The insulating film 112 is formed to have a single-layer or layered structure using an insulating film containing oxygen or nitrogen, such as silicon oxide, silicon nitride, silicon oxynitride, or silicon nitride oxide. For example, in the case where the insulating film 112 is formed to have a two-layer structure, a silicon nitride oxide film and a silicon oxynitride film may be formed for a first layer and a second layer, respectively. As another example, in the case where the insulating film 112 is formed to have a three-layer structure, a silicon oxynitride film, a silicon nitride oxide film, and a silicon oxynitride film are formed for a first layer, a second layer, and a third layer, respectively.

As each of semiconductor layers 113, 114, and 115, an amolphous semiconductor layer, a microcrystalline semiconductor layer, or a polycrystalline semiconductor layer may be used. A crystalline region of from 0.5 nm to 20 nm can be observed in at least part of the film. When silicon is contained as the main component, a Raman spectrum is shifted to a lower wavenumber than 520 $cm^{-1}$. The diffraction peaks of (111) and (220) that are said to be derived from a silicon crystal lattice are observed by X-ray diffraction. Hydrogen or halogen is contained at 1 atomic % or more to compensate a dangling bond. A microcrystalline semiconductor layer is formed by glow discharge decomposition (plasma CVD) of a material gas. As a material gas, $SiH_4$, $Si_2H_6$, $SiH_2Cl_2$, $SiHCl_2$, $SiCl_4$, $SiF_4$, or the like may be used. Further, GeF4 may be mixed. The material gas may be diluted with H2, or H2 and one or more kinds of rare gas elements selected from He, Ar, Kr, and Ne. A dilution ratio is in the range of 2 to 1000 times. Pressure is in the range of approximately 0.1 to 133 Pa, and a power supply frequency is from 1 to 120 MHz, preferably from 13 to 60 MHz. A substrate heating temperature may be set to 300° C. or less. As for impurity elements contained in the film, each concentration of impurities in an atmospheric constituent such as oxygen, nitrogen, or carbon in the film is preferably set to $1\times10^{20}/cm^{-1}$ or lower. In particular, an oxygen concentration is set to $5\times10^{19}/cm^3$ or lower, preferably $1\times10^{19}/cm^3$ or lower. Here, an amorphous semiconductor layer is formed using a material containing silicon as a main component (for example, $Si_xGe_{1-x}$) by a sputtering method, an LPCVD method, a plasma CVD method, or the like and then, the amorphous semiconductor layer is crystallized by a crystallization method such as a laser crystallization method, a thermal crystallization method using RTA or an annealing furnace, or a thermal crystallization method using a metal element which promotes crystallization.

An insulating film 116 is formed to have a single-layer or layered structure using an insulating film containing oxygen or nitrogen, such as silicon oxide, silicon nitride, silicon oxynitride, or silicon nitride oxide.

A gate electrode 117 can have a single-layer structure of a conductive film or a layered structure of two or three conductive films. As a material for the gate electrode 117, a conductive film can be used. For example, a film of an element such as tantalum, titanium, molybdenum, tungsten, chromium, silicon, or the like; a nitride film containing any of such elements (typically, a tantalum nitride film, a tungsten nitride film, or a titanium nitride film); an alloy film in which any of such elements are combined (typically, a Mo—W alloy or a Mo—Ta alloy); a silicide film containing any of such elements (typically, a tungsten silicide film or a titanium silicide film); and the like can be used. Note that the aforementioned single film, nitride film, alloy film, silicide film, and the like can have a single-layer structure or a layered structure.

An insulating film 118 can have a single-layer structure or a layered structure of an insulating film containing oxygen or nitrogen, such as silicon oxide, silicon nitride, silicon oxynitride, or silicon nitride oxide; or a film containing carbon, such as a DLC (diamond like carbon), by a sputtering method, a plasma CVD method, or the like.

An insulating film 119 can have a single-layer or layered structure of a siloxane resin; an insulating film containing oxygen or nitrogen, such as silicon oxide, silicon nitride, silicon oxynitride, or silicon nitride oxide; a film containing carbon, such as DLC (diamond-like carbon); or an organic material such as epoxy, polyimide, polyamide, polyvinyl phenol, benzocyclobutene, or acrylic. Note that the siloxane resin corresponds to a resin having an Si—O—Si bond. The skeletal structure of siloxane includes a bond of silicon (Si) and oxygen (O). An organic group containing at least hydrogen (for example, an alkyl group or aromatic hydrocarbon) is used as the substituent of siloxane. Alternatively, a fluoro group may be used as the substituent. Still alternatively, a fluoro group and an organic group containing at least hydrogen may be used as the substituent. Note that the insulating film 119 can be directly provided so as to cover the gate electrode 117 without providing the insulating film 118.

As a conductive film 123, a single film of an element such as Al, Ni, C, W, Mo, Ti, Pt, Cu, Ta, Au, or Mn, a nitride film containing any of such elements, an alloy film in which any of such elements are combined, a silicide film containing any of such elements, or the like can be used. For example, as an alloy containing some of such elements, an Al alloy containing C and Ti, an Al alloy containing Ni, an Al alloy containing C and Ni, an Al alloy containing C and Mn, or the like can be used. When the conductive film 123 has a layered structure, for example, a structure can be such that Al is interposed by Mo, Ti, or the like; thus, resistance of Al to heat and chemical reaction can be improved.

Next, characteristics of each structure are described with reference to the cross-sectional view of the plurality of transistors having different structures in FIG. 8A.

A transistor 101 is a single drain transistor. Since it can be formed by a simple method, it is advantageous in low manufacturing cost and high yield. Here, the semiconductor layers 113 and 115 have different concentrations of impurities. The semiconductor layer 113 is used for a channel region and the semiconductor layers 115 are used for source and drain regions. By thus controlling the amount of impurities, resistivity of the semiconductor layers can be controlled. An electrical connection state between the semiconductor layer and the conductive film 123 can be closer to ohmic contact. Note that as a method for separately forming the semiconductor layers each having a different amount of impurities, a method in which the semiconductor layer is doped with impurities with the gate electrode 117 used as a mask can be used.

A transistor 102 is a transistor having a gate electrode 117 which is tapered at a certain degrees or more. Since the transistor 102 can be formed by a simple method, it is advantageous in low manufacturing cost and high yield. Here, the semiconductor layers 113, 114, and 115 have different concentrations of impurities. The semiconductor layer 113 is used as a channel region, the semiconductor layers 114 are used as lightly doped drain (LDD) regions, and the semiconductor layers 115 are used as source and drain regions. By thus controlling the amount of impurities, resistivity of the semiconductor layers can be controlled. An electrical connection state between the semiconductor layer and the conductive film 123 can be closer to ohmic contact. Since the transistor 102 includes the LDD region, a high electric field is hardly applied in the transistor, so that deterioration of the element due to hot carriers can be suppressed. Note that as a method for separately forming the semiconductor layers each having a different amount of impurities, a method in which the semiconductor layer is doped with impurities with the gate electrode 117 used as a mask can be used. In the transistor 102, since the gate electrode 117 has a taper angle of certain degrees or more, concentration gradient of impurities with which the semiconductor layer is doped through the gate electrode 117 can be formed, and the LDD region can be easily formed.

A transistor 103 is a transistor in which the gate electrode 117 has a layered structure including at least two layers and a lower gate electrode is longer than an upper gate electrode. In this specification, the shape of the upper gate electrode and the lower gate electrode is referred to as a hat shape. When the gate electrode 117 has such a hat shape, an LDD region can be formed without adding a photomask. Note that a structure in which the LDD region overlaps with the gate electrode 117, like that of the transistor 103, is particularly called a GOLD (gate overlapped LDD) structure. Note that as a method for forming the gate electrode 117 with such a hat shape, the following method may be used.

First, when the gate electrode 117 is patterned, the lower and upper gate electrodes are etched by dry etching so that side surfaces thereof are sloped (tapered). Then, the upper gate electrode is processed by anisotropic etching so that the slopes thereof are almost perpendicular. Thus, the gate electrode having a hat-shaped cross section is formed. Then, doping with impurity elements is conducted in two steps, so that the semiconductor layer 113 used as a channel region, the semiconductor layers 114 used as LDD regions, and the semiconductor layers 115 used as source and drain electrodes are formed.

Note that a portion of the LDD region, which overlaps with the gate electrode 117, is referred to as an Lov region, and a portion of the LDD region, which does not overlap with the gate electrode 117, is referred to as an Loff region. Here, the Loff region is highly effective in suppressing an off-current value, whereas it is not so effective in preventing deterioration in an on-current value due to hot carriers by reducing an electric field in the vicinity of the drain. On the other hand, the Lov region is highly effective in preventing deterioration in the on-current value by reducing the electric field in the vicinity of the drain, whereas it is not so effective in suppressing the off-current value. Thus, it is preferable to form a transistor having a structure depending on characteristics required for each of various circuits. For example, when the semiconductor device is used for a display device, a transistor having an Loff region is preferably used as a pixel transistor in order to suppress the off-current value. On the other hand, as a transistor in a peripheral circuit, a transistor having an Lov region is preferably used in order to reduce the electric field in the vicinity of the drain and thus to prevent deterioration in the on-current value.

A transistor 104 is a transistor including a sidewall 121 in contact with a side surface of the gate electrode 117. When the transistor includes the sidewall 121, a region overlapping with the sidewall 121 can be an LDD region.

A transistor 105 is a transistor in which an LDD (Loff) region is formed by doping the semiconductor layer with impurities with the use of a mask. Thus, the LDD region can reliably be formed, and an off-current value of the transistor can be reduced.

A transistor 106 is a transistor in which an LDD (Lov) region is formed by doping the semiconductor layer with impurities with the use of a mask. Thus, the LDD region can reliably be formed, the electric field in the vicinity of the drain of the transistor is reduced, and deterioration in an on-current value can be prevented.

Next, an example of the manufacturing method of a transistor is described with reference to FIGS. 8B to 8G.

Note that the structure and manufacturing method of a transistor are not limited to those shown in FIGS. 8A to 8G, and various structures and manufacturing methods can be used.

In this embodiment mode, a surface of the substrate 111, a surface of the insulating film 112, a surface of the semiconductor layer 113, a surface of the semiconductor layer 114, a surface of the semiconductor layer 115, a surface of the insulating film 116, a surface of the insulating film 118, or a surface of the insulating film 119 is oxidized or nitrided by using plasma treatment, so that the semiconductor layer or the insulating film can be oxidized or nitrided. By thus oxidizing or nitriding the semiconductor layer or the insulating film by plasma treatment, a surface of the semiconductor layer or the insulating film is modified, and the insulating film can be formed to be denser than an insulating film formed by a CVD method or a sputtering method; thus, a defect such as a pinhole can be suppressed, and characteristics and the like of the semiconductor device can be improved.

Note that the sidewall 121 can be formed using silicon oxide or silicon nitride. As a method for forming the sidewall 121 on the side surface of the gate electrode 117, a method in which a silicon oxide or silicon nitride film is formed after the gate electrode 117 is formed, and then, the silicon oxide or silicon nitride film is etched by anisotropic etching can be used, for example. Thus, the silicon oxide or silicon nitride film remains only on the side surface of the gate electrode 117, so that the sidewall 121 can be formed on the side surface of the gate electrode 117.

As described above, by using the method for forming a transistor in this embodiment mode, the display device of the present invention can be manufactured.

Next, an example in which a semiconductor substrate is used as a substrate for a transistor is described. Having high mobility, a transistor formed using a semiconductor substrate can be reduced in size. Accordingly, the number of transistors per unit area can be increased (the integration degree can be increased), and the higher the integration degree is, the smaller the size of the substrate can be in the case of the same circuit configuration. Thus, manufacturing cost can be reduced. Further, the higher the integration degree is, the larger the circuit scale can be in the case of the same substrate size; therefore, more advanced functions can be provided without increase in manufacturing cost. Moreover, small variations in characteristics can increase manufacturing yield. Further, a low operating voltage can reduce power consumption. Furthermore, high mobility enables higher-speed operation.

When a circuit formed of transistors which are formed using a semiconductor substrate is mounted on a device in the form of an IC chip or the like, the device can be provided with various functions. For example, a peripheral driver circuit (a data driver (source driver), a scanning driver (gate driver), a timing controller, an image processing circuit, an interface circuit, a power supply circuit, an oscillation circuit, or the like) of a display device is formed of transistors which are formed using a semiconductor substrate, so that a small peripheral circuit which can be operated with low power consumption and at high speed can be formed at low cost in high yield. Note that a circuit which is formed by forming transistors over a semiconductor substrate may have a unipolar transistor. Thus, a manufacturing process can be simplified, so that manufacturing cost can be reduced.

A circuit formed of transistors which are formed using a semiconductor substrate may also be used for a display panel, for example. More specifically, the circuit can be used for a reflective liquid crystal panel such as a liquid crystal on silicon (LCOS) device, a digital micromirror device (DMD) panel in which micromirrors are arranged, an EL panel, and the like. By forming such a display panel with the use of a semiconductor substrate, a small display panel which can be operated with low power consumption at high speed can be formed at low cost in high yield. Note that the display panel may be formed over an element having a function other than a function to drive the display panel, such as a large-scale integration (LSI).

A method for forming a transistor with the use of a semiconductor substrate is described below. As an example, such steps as shown in FIGS. 9A to 9C and FIGS. 10A to 10D may be used for forming a transistor.

In FIGS. 9A to 9C and FIG. 10A to 10D, regions 604 and 606 in each of which an element is separated, an insulating film (also referred to as a field oxide film) 602, a p-well 607 are shown in the semiconductor substrate 600.

A semiconductor substrate that can be used as the semiconductor substrate 600 is not particularly limited as long as it is a semiconductor substrate. For example, a single crystal Si substrate having n-type or p-type conductivity, a compound semiconductor substrate (a GaAs substrate, an InP substrate, a GaN substrate, a SiC substrate, a sapphire substrate, a ZnSe substrate, or the like), an SOI (silicon on insulator) substrate formed by a bonding method or a SIMOX (separation by implanted oxygen) method, or the like can be used.

Further, in FIGS. 9A to 9C and FIG. 10A to 10D, the insulating film 632 and the insulating film 634 are shown. For example, surfaces of the regions 604 and 606 provided in the semiconductor substrate 600 are oxidized by heat treatment, so that the insulating films 632 and 634 can be formed of silicon oxide films.

Further, in FIGS. 9A to 9C and FIGS. 10A to 10D, a conductive film 636 and a conductive film 638 are shown.

The conductive films 636 and 638 can be formed using an element selected from tantalum (Ta), tungsten (W), titanium (Ti), molybdenum (Mo), aluminum (Al), copper (Cu), chromium (Cr), niobium (Nb), or the like or an alloy or compound material containing any of such elements as its main component. Alternatively, a metal nitride film obtained by nitriding any of such elements may be used. Still alternatively, a semiconductor material typified by polycrystalline silicon doped with an impurity element such as phosphorus or silicide into which a metal material is introduced may be used.

Further, in FIGS. 9A to 9C and FIG. 10A to 10D, gate electrodes 640 and 642, a resist mask 648, an impurity region 652, a channel formation region 650, a resist mask 666, an impurity region 670, a channel formation region 668, a second insulating film 672, and a wiring 674 are shown.

The second insulating film 672 can be formed to have a single-layer or layered structure of an insulating film containing oxygen or nitrogen, such as silicon oxide, silicon nitride, silicon oxynitride, or silicon nitride oxide; a film containing carbon such as DLC (diamond-like carbon); an organic material such as epoxy, polyimide, polyamide, polyvinyl phenol, benzocyclobutene, or acrylic; or a siloxane material such as a siloxane resin, by a CVD method, a sputtering method or the like. Note that the siloxane material corresponds to a material having an Si—O—Si bond. The skeletal structure of siloxane includes a bond of silicon and oxygen. An organic group containing at least hydrogen (for example, an alkyl group or aromatic hydrocarbon) is used as the substituent of siloxane. Alternatively, a fluoro group may be included in the organic group.

The wirings 674 are formed to have a single-layer or layered structure of an element selected from aluminum, tungsten, titanium, tantalum, molybdenum, nickel, platinum, copper, gold, silver, manganese, neodymium, carbon, or silicon, or an alloy or compound material containing any of such elements as its main component by a CVD method, a sputtering method, or the like. An alloy material containing aluminum as a main component corresponds to, for example, a material containing aluminum as a main component and also containing nickel, or an alloy material containing aluminum as a main component and also containing nickel and one or both of carbon and silicon. The wirings 674 may employ, for example, a layered structure of a barrier film, an aluminum-silicon (Al—Si) film, and a barrier film, or a layered structure of a barrier film, an aluminum-silicon (Al—Si) film, a titanium nitride film, and a barrier film. Note that a barrier film corresponds to a thin film formed using titanium, a nitride of titanium, molybdenum, or a nitride of molybdenum. Aluminum and aluminum silicon which have low resistance and are inexpensive are optimal materials for forming the wirings 674. For example, by providing barrier layers as an upper layer and a lower layer, generation of hillocks of aluminum or aluminum silicon can be prevented. For example, when a barrier film is formed of titanium which is an element having a high reducing property, even if a thin natural oxide film is formed on a crystalline semiconductor film, the natural oxide film can be reduced. As a result, the wirings 674 can be connected to the crystalline semiconductor film in an electrically and physically favorable condition.

Note that the structure of a transistor is not limited to the structure shown in the drawing. For example, a transistor with an inversely staggered structure, a FinFET structure, or the like can be used. A FinFET structure is preferable because it can suppress a short channel effect accompanied with reduction in transistor size.

Heretofore, the structures and manufacturing methods of transistors are described. Here, a wiring, an electrode, a conductive layer, a conductive film, a terminal, a via, a plug, or the like is preferably formed using one or a plurality of elements selected from aluminum, tantalum, titanium, molybdenum, tungsten, neodymium, chromium, nickel, platinum, gold, silver, copper, magnesium, scandium, cobalt, zinc, niobium, silicon, phosphorus, boron, arsenic, gallium, indium, tin, and oxygen; a compound or alloy material containing one or a plurality of the elements selected from such elements as a component (for example, indium tin oxide (ITO), indium zinc oxide (IZO), indium tin oxide containing silicon oxide (ITSO), zinc oxide, tin oxide, cadmium tin oxide, aluminum neodymium (Al—Nd), or magnesium silver (Mg—Ag)), or molybdenum niobium (Mo—Nb)); or the like. Alternatively, a wiring, an electrode, a conductive layer, a conductive film, a terminal are preferably formed to have a substance combining any of such compounds; a compound of silicon and one or a plurality of elements selected from such elements (silicide) (for example, aluminum silicon, molybdenum silicon, or nickel silicide); or a compound of nitrogen and one or a plurality of elements selected from such elements (for example, titanium nitride, tantalum nitride, or molybdenum nitride).

Note that silicon may contain an n-type impurity (such as phosphorus) or a p-type impurity (such as boron). The impurity contained in silicon can increase the conductivity or enables the same performance as normal conductors. Thus, such silicon can be easily utilized for a wiring, an electrode, or the like.

Note that silicon with various crystallinity, such as single crystal silicon, polycrystalline silicon (polysilicon), or microcrystalline silicon, can be used as silicon. Alternatively, silicon with no crystallinity, such as amorphous silicon, can be used as silicon. By using single crystal silicon or polycrystalline silicon, resistance of a wiring, an electrode, a conductive layer, a conductive film, a terminal, or the like can be reduced. By using amorphous silicon or microcrystalline silicon, a wiring or the like can be formed through a simple process.

Note that since ITO, IZO, ITSO, zinc oxide, silicon, tin oxide, and cadmium tin oxide have light-transmitting properties, they can be used as a portion which transmits light. For example, such materials can be used as a pixel electrode or a common electrode.

Note that IZO is desirable because it can be easily etched and processed. IZO hardly generates a residue when it is etched. Thus, when IZO is used for a pixel electrode, defects (such as a short circuit or orientation disorder) of a liquid crystal element or a light-emitting element can be reduced.

Note that a wiring, an electrode, a conductive layer, a conductive film, a terminal, a via, a plug, or the like may have a single-layer structure or a multilayer structure. By adopting a single-layer structure, a manufacturing process of a wiring, an electrode, a conductive layer, a conductive film, a terminal, or the like can be simplified; the number of days for the process can be reduced; and cost can be reduced. Alternatively, by adopting a multi-layer structure, a wiring, an electrode, or the like with a high performance can be formed while the advantage of each material is utilized and the disadvantage thereof is reduced. For example, a low-resistant material (such as aluminum) is included in a multilayer structure, and thus the resistance of such a wiring is reduced. As another example, by adopting a layered structure in which a low heat-resistant material is interposed between high heat-resistant materials, heat resistance of a wiring, an electrode, or the like can be increased, utilizing the advantage of the low heat-resistant material. For example, a layered structure is desirable in which a layer containing aluminum is desirably interposed between layers containing molybdenum, titanium, neodymium, or the like.

Here, when wirings, electrodes, or the like are in direct contact with each other, they might adversely affect each other. For example, one of wirings, electrodes, or the like is mixed into another of the wirings, electrodes, or the like and changes the property, and thus, the original function cannot be performed. As another example, when a high-resistant portion is formed, a problem may possibly occur so that it cannot be normally formed. In such a case, a reactive material is preferably interposed by or covered with a non-reactive material in a layered structure. For example, when ITO and aluminum are connected, it is desirable to sandwich an alloy of titanium, molybdenum, or neodymium between ITO and aluminum. As another example, when silicon is connected to aluminum, an alloy of titanium, molybdenum, or neodymium is desirably disposed between the silicon and the aluminum.

Note that the term "wiring" indicates a portion including a conductor. Such a wiring may have a linear shape or may be short without having a linear shape. Therefore, an electrode is included in such a wiring.

Note that a carbon nanotube may be used for a wiring, an electrode, a conductive layer, a conductive film, a terminal, a via, a plug, or the like. Since a carbon nanotube has a light-transmitting property, it can be used for a portion which transmits light. For example, such a material can be used for a pixel electrode or a common electrode.

As described above, a transistor of the display device of the present invention can be formed using the method for forming a transistor of this embodiment mode. Further, the display device of the present invention can be manufactured by combining the transistor of the present invention and a wiring, a circuit, an element, and the like.

Next, an example of the structure of a display device to which the present invention can be applied is described.

Figure 11A:
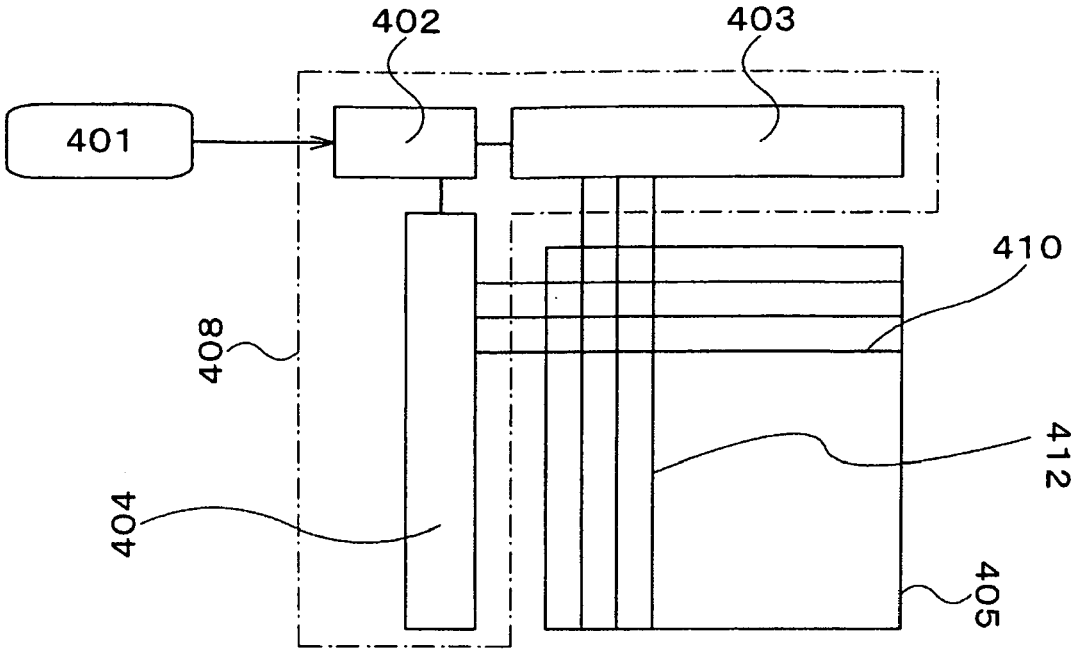
FIGS. 11A to 11C are block diagrams each illustrating a display device to which the present invention can be applied.
Figure 11B:
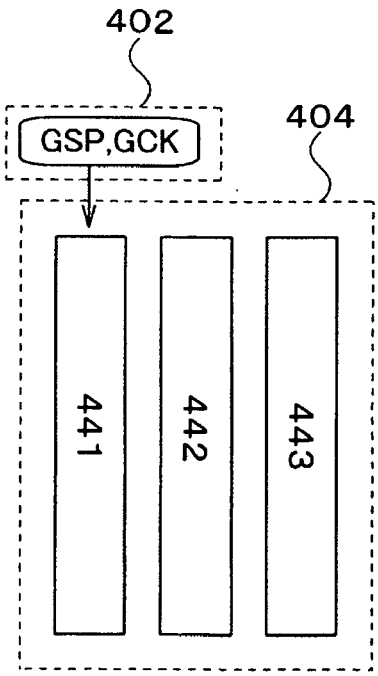
Figure 11C:
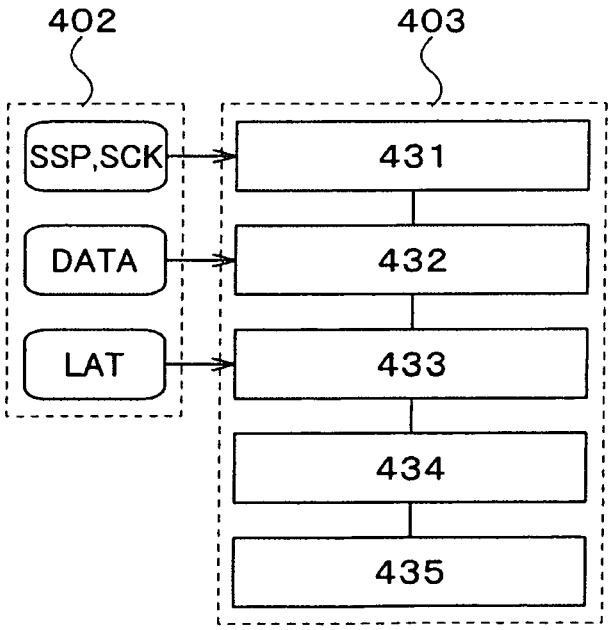

FIGS. 11A to 11C are block diagrams illustrating an example of a display device to which the present invention can be applied. The display device in this embodiment mode includes a pixel portion 405 and a driver circuit portion 408. In the pixel portion 405, signal lines 412, which are extended from a signal line driver circuit 403, and scanning lines 410, which are extended from a scanning line driver circuit 404, are provided. In addition, a plurality of pixels are arranged in matrix at intersection regions of the signal lines 412 and the scanning lines 410. Note that each of the plurality of pixels includes a switching element. Therefore, a voltage for controlling inclination of liquid crystal molecules can be individually applied to each of the plurality of pixels.

The driver circuit portion 408 includes a control circuit 402, the signal line driver circuit 403, and the scanning line driver circuit 404. The image signal 401 is inputted to the control circuit 402. The signal line driver circuit 403 and the scanning line driver circuit 404 are controlled by the control circuit 402 in accordance with the image signal 401. Therefore, the control circuit 402 inputs a control signal to each of the signal line driver circuit 403 and the scanning line driver circuit 404. Then, in accordance with the control signal, the signal line driver circuit 403 inputs a video signal to each of the signal lines 412 and the scanning line driver circuit 404 inputs a scanning signal to each of the scanning lines 410. Then, the switching element included in the pixel is selected in accordance with the scanning signal, and the video signal is inputted to a pixel electrode of the pixel.

Note that the control circuit 402 may have a structure including a power source and a lighting unit. The power source includes a means for controlling power in accordance with the image signal 401 to supply the power to the lighting unit. As the lighting unit, an edge-light type backlight unit or a direct-type backlight unit may be used. Note that a front light may be used as the lighting unit 406. A front light refers to a plate-like lighting unit including a luminous body and a light conducting body, which is attached to the front surface side of a pixel portion and illuminates the whole area. Such a lighting unit can uniformly illuminate the pixel portion with low power consumption.

As shown in FIG. 11B, the scanning line driver circuit 404 includes a shift register 441, a level shifter 442, and a circuit which serves as a buffer 443. Signals such as a gate start pulse (GSP) and a gate clock signal (GCK) are inputted to the shift register 441.

As shown in FIG. 11C, the signal line driver circuit 403 includes a shift register 431, a first latch 432, a second latch 433, a level shifter 434, and a circuit which serves as a buffer 435. The circuit which serves as the buffer 435 is a circuit which has a function of amplifying weak signals, and includes an operational amplifier or the like. A signal such as a start pulse (SSP) is inputted to the level shifter 434, and data (DATA) such as a video signal is inputted to the first latch 432. Latch (LAT) signals can be held temporarily in the second latch 433 and inputted to the pixel portion 405 concurrently. This operation is referred to as line sequential drive. Therefore, a pixel which performs not line sequential drive but dot sequential drive does not require the second latch.

Note that in this embodiment mode, various pixel structures can be used as the pixel structure of the pixel portion. For example, a structure in which a liquid crystal layer is sealed between two substrates can be used for a display panel. A transistor, a capacitor, a pixel electrode, an alignment film, or the like is formed over one of the substrates. Note that a polarizing plate, a retardation plate, or a prism sheet may be provided on the surface opposite to the top surface of the one of the substrates. A color filter, a black matrix, a counter electrode, an alignment film, or the like is provided over the other substrate. Note that a polarizing plate or a retardation plate may be provided on the surface opposite to the top surface of the other substrate. Note also that the color filter and the black matrix may be formed on the top surface of the one of the substrates. Note also that three-dimensional display can be performed by providing a slit (grid) on the top surface side of the one of the substrates or the side opposite to the top surface side of the one of the substrates.

Note also that each of the polarizing plate, the retardation plate, and the prism sheet can be provided between the two substrates. Alternatively, each of the polarizing plate, the retardation plate, and the prism sheet can be integrated with one of the two substrates.

As a pixel structure, a structure using a light-emitting element in which an EL (electroluminescence) material is provided between two electrodes may be applied.

In a light emitting element using an EL material, the case where light is emitted to the pixel electrode side, that is, a side on which the transistor and the like are formed is referred to as bottom emission, and the case where light is emitted to the counter electrode side is referred to as top emission.

In the case of bottom emission, it is preferable that the pixel electrode be formed of a transparent conductive film. On the other hand, in the case of top emission, it is preferable that the counter electrode be formed of a transparent conductive film.

In a light-emitting device for color display, light-emitting elements having respective light emission colors of RGB may be separately formed, or a light-emitting element with a single color may be formed over an entire surface and light emission of RGB may be obtained by using a color filter.

As described above, various structures can be applied to the display device of the present invention.

An active matrix display device of the present invention can be applied to various electronic appliances. For example, a desktop display, a floor-stand display, or a wall-hung type display; a camera such as a video camera or a digital camera; a goggle display; a navigation system; an audio reproducing device (a car audio, an audio component stereo, or the like); a computer; a game machine; a portable information terminal (a mobile computer, a mobile phone, a portable game machine, an electronic book, or the like); an image reproducing device provided with a recording medium (specifically, a device for reproducing video or still images recorded in a recording medium such as a digital versatile disc (DVD) and having a display for displaying the reproduced video or still images); or the like can be given. Specific examples of these electronic appliances are shown in FIGS. 12A to 12H.

Figure 12A:
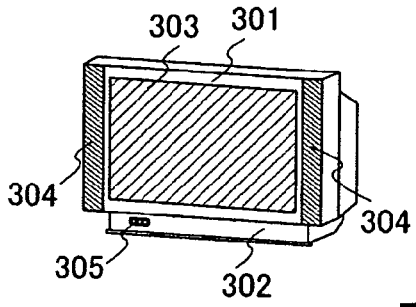
FIGS. 12A to 12H are perspective diagrams each illustrating an electronic appliance to which the present invention is applied.

FIG. 12A shows a desktop display, a floor-stand display, or a wall-hung type display, which includes a housing 301, a supporting base 302, a display portion 303, a speaker portion 304, a video input terminal 305, and the like. Such a display can be used as any display device for displaying information, for example, for a personal computer, for TV broadcast reception, or for advertisement display. An active matrix display device of the present invention can be used for the display portion 303 of such a display, so that deterioration of a transistor in the display portion can be prevented and thus reliability can be improved. Further, by reducing the voltage of a data line, power consumption can be reduced.

Figure 12B:
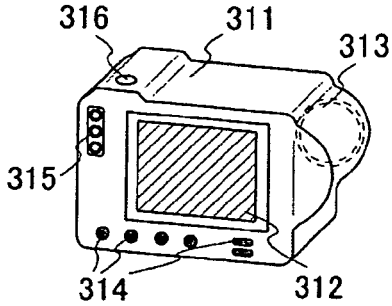

FIG. 12B shows a digital camera which includes a main body 311, a display portion 312, an image receiving portion 313, operating keys 314, an external connection port 315, a shutter button 316, and the like. An active matrix display device of the present invention can be used for the display portion 312 of such a digital camera, so that deterioration of a transistor in the display portion can be prevented and thus reliability can be improved. Further, by reducing the voltage of a data line, power consumption can be reduced.

Figure 12C:
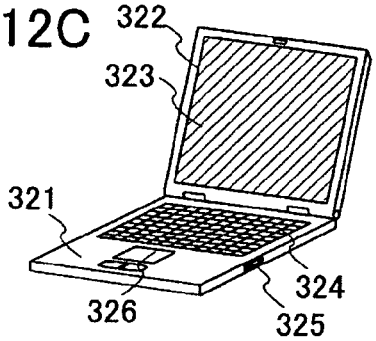

FIG. 12C shows a computer which includes a main body 321, a housing 322, a display portion 323, a keyboard 324, an external connection port 325, a pointing device 326, and the like. Note that the computer includes a so-called laptop computer on which a central processing unit (CPU), a recording medium, and the like are mounted, and a so-called desktop computer provided with them separately. An active matrix display device of the present invention can be used for the display portion 323 of such a computer, so that deterioration of a transistor in the display portion can be prevented and thus reliability can be improved. Further, by reducing the voltage of a data line, power consumption can be reduced.

Figure 12D:
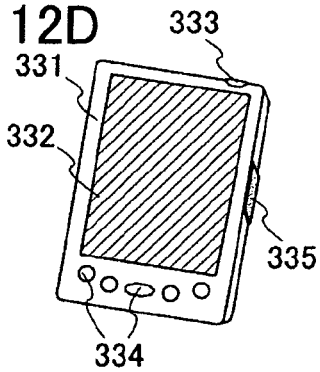

FIG. 12D shows a mobile computer which includes a main body 331, a display portion 332, a switch 333, operating keys 334, an infrared port 335, and the like. An active matrix display device of the present invention can be used for the display portion 332 of such a mobile computer, so that deterioration of a transistor in the display portion can be prevented and thus reliability can be improved. Further, by reducing the voltage of a data line, power consumption can be reduced.

Figure 12E:
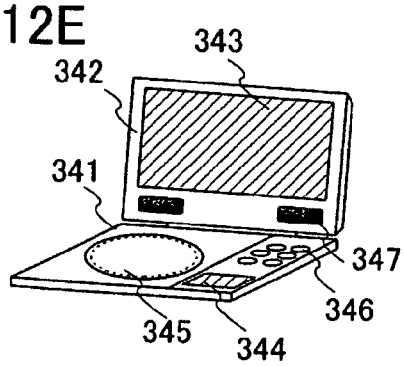

FIG. 12E shows a portable image reproducing device provided with a recording medium (specifically, a DVD reproducing device), which includes a main body 341, a housing 342, a first display portion 343, a second display portion 344, a recording medium (DVD or the like) reading portion 345, an operating key 346, a speaker portion 347, and the like. The first display portion 343 mainly displays image data and the second display portion 344 mainly displays text data. Note that the image reproducing device provided with a recording medium also includes a home-use game machine and the like. An active matrix display device of the present invention can be used for the display portions 343 and 344 of such an image reproducing device, so that deterioration of a transistor in the display portion can be prevented and thus reliability can be improved. Further, by reducing the voltage of a data line, power consumption can be reduced.

Figure 12F:
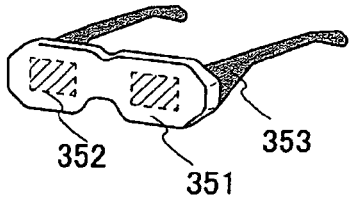

FIG. 12F shows a goggle display which includes a main body 351, a display portion 352, an arm portion 353, and the like. An active matrix display device of the present invention can be used for the display portion 352 of such a goggle display, so that deterioration of a transistor in the display portion can be prevented and thus reliability can be improved. Further, by reducing the voltage of a data line, power consumption can be reduced.

Figure 12G:
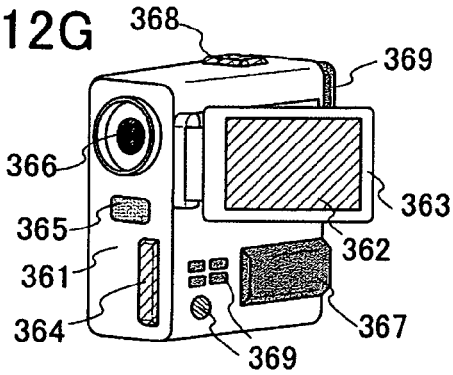

FIG. 12G shows a video camera which includes a main body 361, a display portion 362, a housing 363, an external connection port 364, a remote control receiving portion 365, an image receiving portion 366, a battery 367, an audio inputting portion 368, operation keys 369, and the like. An active matrix display device of the present invention can be used for the display portion 362 of such a video camera, so that deterioration of a transistor in the display portion can be prevented and thus reliability can be improved. Further, by reducing the voltage of a data line, power consumption can be reduced.

Figure 12H:
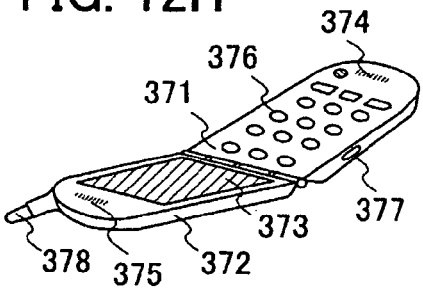

FIG. 12H shows a mobile phone which includes a main body 371, a housing 372, a display portion 373, an audio input portion 374, an audio output portion 375, an operating key 376, an external connection port 377, an antenna 378, and the like. An active matrix display device of the present invention can be used for the display portion 362 of such a mobile phone, so that deterioration of a transistor in the display portion can be prevented and thus reliability can be improved. Further, by reducing the voltage of a data line, power consumption can be reduced.

Note that the display portions of the electronic appliances described above may be formed as a self-light-emitting type in which a light-emitting element such as an LED or an organic EL is used for each pixel, or may be formed as another type in which a light source such as a backlight is used like a liquid crystal display. In the case of a self-light-emitting type, a backlight is not required and a display portion can be thinner than a liquid crystal display.

Moreover, the above electronic appliances have been increasingly used for displaying data distributed through an electronic communication line such as the Internet and a CATV (cable television) or used as TV receptors. In particular, an opportunity for displaying moving image data is increasing. A display device of a self-light-emitting type is suitable for such a moving image display since a light-emitting material such as an organic EL material responds much faster than that of a liquid crystal. Further, it is also suitable for performing time division driving. When the luminance of a light-emitting material is increased in the future, the light-emitting material can be used for a front or rear projector by magnifying and projecting outputted light containing image data by a lens or the like.

Since a light-emitting portion of a self-light-emitting display portion consumes power, it is desirable to display data so that the light-emitting portion is as small as possible. Therefore, in the case where a display portion of a portable information terminal, in particular, of a mobile phone, an audio reproducing device, or the like which mainly displays text data is of a self-light-emitting type, it is desirable to perform driving so that a light-emitting portion displays text data while a non-light-emitting portion serves as the background.

As described above, an application range of the present invention extremely wide and the present invention can be applied to electronic appliances of various fields.

This application is based on Japanese Patent Application serial no. 2007-181889 filed with Japan Patent Office on Jul. 11, 2007, the entire contents of which are hereby incorporated by reference.

What is claimed is:

1. An active matrix display device comprising:

a capacitor of a pixel provided for each pixel;

N (N is a positive integer which is 2 or larger) storage capacitors provided for each pixel;

at least three transistors in a first group;

a transistor in a second group; and a data line, wherein when the at least three transistors in the first group are on and the transistor in the second group is off, the capacitor of the pixel and the N storage capacitors are connected in parallel with each other between the data line and a reference potential, and wherein when the at least three transistors in the first group are off and the transistor in the second group is on, the N storage capacitors are connected in series, one terminal of these serially connected capacitors is connected to the reference potential, the other terminal is connected to a first terminal of the capacitor of the pixel, and a second terminal of the capacitor of the pixel is connected to the reference potential.

2. An active matrix display device comprising:

a capacitor of a pixel provided for each pixel;

N (N is a positive integer which is 2 or larger) storage capacitors provided for each pixel separately from the capacitor of the pixel;

transistors in a first group, having a first conductivity type;

transistors in a second group, having a second conductivity type opposite to the first conductivity type; and a data line;

wherein the transistors in the first group comprises:

a transistor connected between the data line and a first terminal of a first storage capacitor of the N storage capacitors;

a transistor connected between a first terminal of an i-th ($2 \leqq i \leqq N$, i is a positive integer) storage capacitor of the N storage capacitors and a first terminal of a (i−1) th storage capacitor; and a transistor connected between the reference potential and a second terminal of the i-th storage capacitor, wherein transistors in the second group comprising:

a transistor connected between a first terminal of a j-th ($1 \leqq j \leqq (N-1)$, j is a positive integer) storage capacitor of the N storage capacitors and a second terminal of a (j+1)-th storage capacitor, and wherein a second terminal of the first storage capacitor is connected to the reference potential, a first terminal of an N-th storage capacitor is connected to the first terminal of the capacitor of the pixel, and a second terminal of the capacitor of the pixel is connected to the reference potential.

3. The active matrix display device according to claim 1, wherein capacitance of the N storage capacitors is higher than that of the capacitance of the pixel.

4. The active matrix display device according to claim 2, wherein capacitance of each of the N storage capacitors is higher than that of the capacitor of the pixel.

5. The active matrix display device according to claim 1, wherein total capacitance of the storage capacitors of at least two different pixels when the storage capacitors are connected in parallel is different from each other.

6. The active matrix display device according to claim 2, wherein total capacitance of the storage capacitors of at least two different pixels when the storage capacitors are connected in parallel is different from each other.

7. The active matrix display device according to claim 1, wherein the capacitor of the pixel is a capacitor of a liquid crystal in a pixel formed with a pixel electrode, a counter electrode, and a liquid crystal.

8. The active matrix display device according to claim 2, wherein the capacitor of the pixel is a capacitor of a liquid crystal in a pixel formed with a pixel electrode, a counter electrode, and a liquid crystal.

9. The active matrix display device according to claim 1, wherein a self light-emitting material is provided between a pixel electrode and an opposed electrode of each pixel.

10. The active matrix display device according to claim 2, wherein a self light-emitting material is provided between a pixel electrode and an opposed electrode of each pixel.

11. The active matrix display device according to claim 1, wherein the active matrix display device is incorporated in one selected from the group consisting of a desktop display, a camera, a computer, an image reproducing device, a goggle display, and a mobile phone.

12. The active matrix display device according to claim 2, wherein the active matrix display device is incorporated in one selected from the group consisting of a desktop display, a camera, a computer, an image reproducing device, a goggle display, and a mobile phone.

13. The active matrix display device according to claim 1, wherein a voltage obtained by raising a potential difference between a potential of the data line and the reference potential is applied to the capacitor of the pixel as a result of a serial connection of the N storage capacitors which store charge in accordance with the potential difference.

14. The active matrix display device according to claim 2, wherein a voltage obtained by raising a potential difference between a potential of the data line and the reference potential is applied to the capacitor of the pixel as a result of a serial connection of the N storage capacitors which store charge in accordance with the potential difference.

15. The active matrix display device according to claim 1, wherein gate electrodes of the at least three transistors in the first group and the transistor in the second group are connected to a scanning line in common.

16. The active matrix display device according to claim 2, wherein gate electrodes of the transistors in the first group and the transistors in the second group are connected to a scanning line in common.

17. The active matrix display device according to claim 1, wherein the at least three transistors in the first group has have a different conductivity type from that the transistor in the second group has.

18. The active matrix display device according to claim 1, wherein the at least three transistors in the first group or the transistor in the second group can be exclusively turned on or off.

19. The active matrix display device according to claim 2, wherein the transistors in the first group or the transistors in the second group can be exclusively turned on or off.

20. The active matrix display device according to claim 1, wherein the at least three transistors in the first group and the transistor in the second group include LDD regions.

21. The active matrix display device according to claim 2, wherein the transistors in the first group and the transistors in the second group include LDD regions.

22. The active matrix display device according to claim 1, wherein the at least three transistors in the first group and the transistor in the second group include Loff regions.

23. The active matrix display device according to claim 2, wherein the transistors in the first group and the transistors in the second group include Loff regions.

* * * * *